US005265860A

United States Patent [19]

Janson et al.

[11] Patent Number: 5,265,860

[45] Date of Patent: Nov. 30, 1993

[54] PACKAGE BLANK ADVANCING MECHANISM INCLUDING ENDLESS BELT DRIVEN BY CONTACTING SHAFT

[75] Inventors: Magnus Janson, Oxie; Jonny Olander, Trelleborg, both of Sweden

[73] Assignee: Tetra Alfa Holdings SA, Pully, Switzerland

[21] Appl. No.: 951,834

[22] Filed: Sep. 28, 1992

[30] Foreign Application Priority Data

Oct. 2, 1991 [SE] Sweden ..... 9102849

[51] Int. Cl.[5] ..... B65H 1/02

[52] U.S. Cl. ..... 271/149; 271/150

[58] Field of Search ..... 271/35, 147-150, 271/275

[56] References Cited

U.S. PATENT DOCUMENTS 924,637 6/1909 Cox ..... 271/148
1,948,362 7/1932 Staude .
4,364,549 12/1982 Komossa et al. .

FOREIGN PATENT DOCUMENTS 0339178 11/1989 European Pat. Off. .
0375146 6/1990 European Pat. Off. .

*Primary Examiner*—Robert P. Olszewski
*Assistant Examiner*—Boris Milef
*Attorney, Agent, or Firm*—Burns, Doane, Swecker & Mathis

[57] ABSTRACT

A mechanism for advancing flat-laid package blanks disposed in a magazine includes a shaft extending through the mechanism at right angles to the magazine and journalled by way of a free-wheel hub so that it may rotate in only one direction. The shaft is urged against at least one endless elastic belt which passes around two or more wheels. The belt presses against the flat-laid package blanks. The free-wheel hub is surrounded by a lever that is connected to a drive unit. When the lever is pivoted in one direction by the drive unit, the movement is transferred via the shaft to the belt and the package blanks are fed forwardly in the magazine. When the lever is pivoted in the other direction, the free-wheel hub locks and no movement is transmitted to the belt which might otherwise counteract the forward advancement of the package blanks in the magazine.

13 Claims, 2 Drawing Sheets

PACKAGE BLANK ADVANCING MECHANISM INCLUDING ENDLESS BELT DRIVEN BY CONTACTING SHAFT

FIELD OF THE INVENTION

The present invention relates to a mechanism for the individual advancement of flat-laid package blanks in a magazine, and more particularly to a mechanism for individually advancing flat-laid package blanks in a magazine through use of an endless elastic belt driven by a rotating shaft.

BACKGROUND ART

Single-use disposable packages for liquid contents are often manufactured today from a laminate that includes a core of paper or cardboard and different layers of plastic. Some of these disposable packages start from package blanks, i.e. the packaging material piece which is required for making a package, which are sealed on one longitudinal side so that the package blank constitutes a square tube. The package blanks are supplied to the packaging (or filling) machines in a flat-laid manner and stacked in bundles. The flat-laid package blanks are thereafter loaded into a magazine connected to a packaging machine. From the magazine, the package blanks still flat-laid are fed into the packaging machine are righted to square tubes, and are sealed on one end wall. The packages are then filled and the final package is sealed at its other end wall.

The infeed of the flat-laid package blanks can constitute a problem, since the package blanks can become bent in the event of unsuitable storage. Careless loading on the part of the machine operator can also cause problems during infeed of the package blanks.

Prior art infeed devices have consisted of fingers which advance the package blanks. However, the problems associated with such devices involved that the stroke movements of the fingers is relatively short when the fact package blanks have been bent, this short stroke movement has not proved sufficient to advance a new package blank. These fingers also include a reciprocating return movement after each advancement, and thus there is the risk that the package blanks will be retracted a slight distance.

OBJECTS AND SUMMARY OF THE INVENTION

One object of the present invention is to obviate the above-outlined drawbacks and to realize an even and reliable infeed of the package blanks without being concerned about the quality of the package blanks or how they are loaded.

A further object of the present invention is to avoid the return stroke difficulties experienced by prior art infeed devices.

These and other objects have been attained according to the present invention in that a mechanism for individually advancing package blanks includes a shaft journalled so that it may rotate only in one direction, a lever cooperating with this shaft, the lever being reciprocally pivotal and connected to a drive unit, the shaft being urged against at least one endless elastic belt oriented in the longitudinal direction of the magazine, and the belt interconnecting two or more wheels and being urged against the upper edge of the package blanks.

BRIEF DESCRIPTION OF THE DRAWING FIGURES

One preferred embodiment of the present invention will not be described in greater detail hereinbelow, with particular reference to the accompanying drawings, in which: like elements bear like reference numerals and wherein:

FIG. 1 is a perspective view of the mechanism according to the present invention; and FIG. 2 is a side elevation of the mechanism of FIG. 1, partly in section.

DETAILED DESCRIPTION OF THE PREFERRED EMBODIMENT

Figure 1:
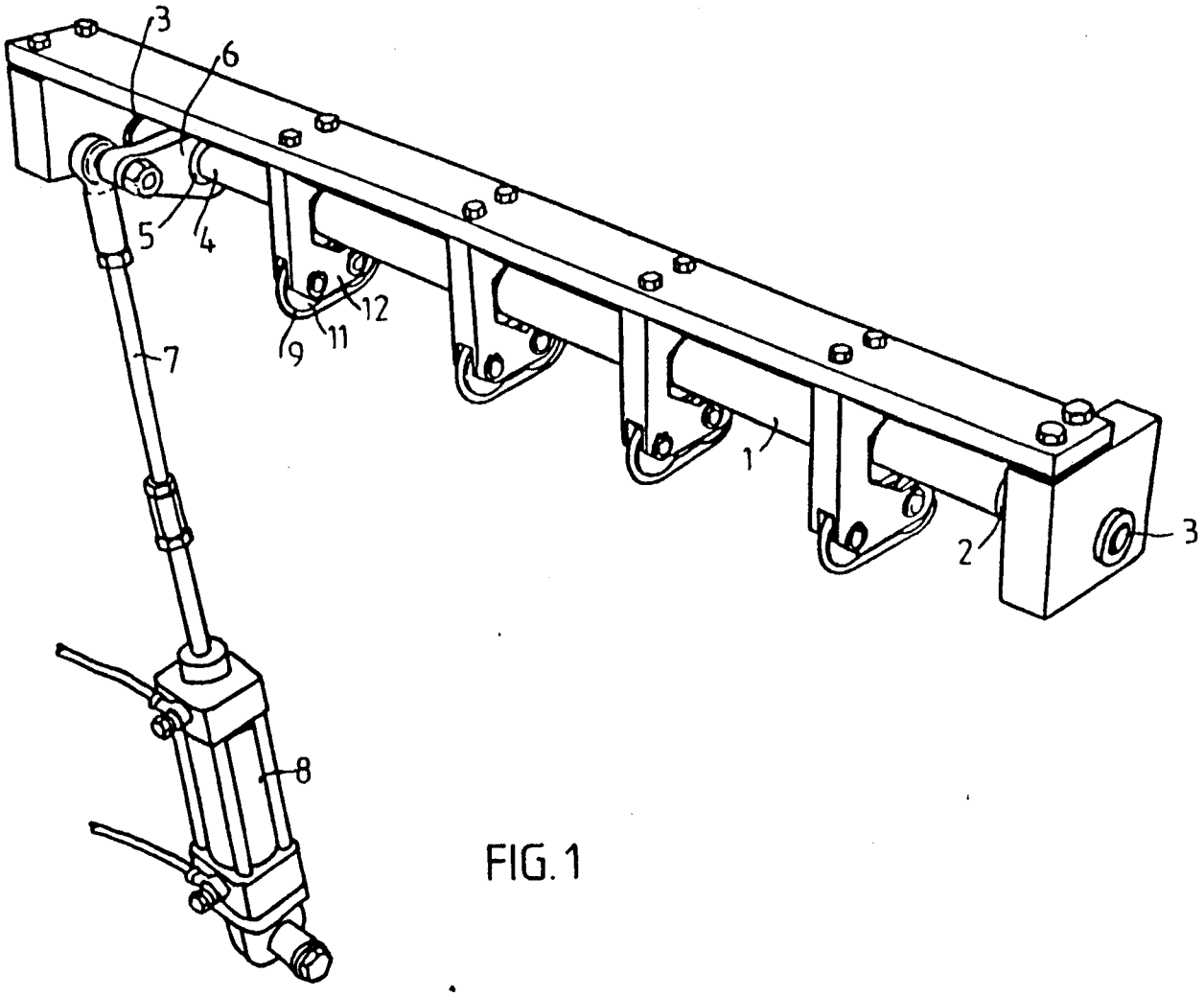

The drawings show only those details essential to an understanding of the present invention.

The infeed mechanism includes a shaft 1 extending through the greater part of the mechanism. The shaft 1 is oriented at right angles to a magazine 14 holding flat-laid package blanks 10. At both ends 2 and 4, the shaft 1 is journalled with a conventional bearing such as a ball bearing or sliding bearing 3. At one end 4, the shaft 1 is moreover journalled so that it may rotate in only one direction, with a so-called free-wheel hub 5 or reverse stop. The free-wheel hub 5 is surrounded by a lever 6. This lever 6 is, in its turn, interconnected with a piston rod 7. The piston rod 7 is displaceable with a reciprocating movement and is connected to a drive unit, preferably a pneumatic piston and cylinder assembly 8. The drive unit may also consist of a hydraulic piston and cylinder assembly. In the preferred embodiment, the lever 6 receives its movement via a piston rod 7, but other solutions are also conceivable here, such as a cam.

The shaft 1 extending through the mechanism is urged against at least one elastic belt 9 oriented in the longitudinal direction of the magazine 14. In FIG. 1, four such belts 9 are shown, but this number may of course be varied, depending upon the length of the package blanks 10 which are to be fed through the mechanism. The belt or belts 9 each interconnect or pass around at least two wheels 11 which are anchored in a bracket 12 for each belt 9. By employing two wheels 11, a suitable pressure point 13 for the shaft 1 will be created between the wheels 11. In turn, the belts 9 are urged against the upper edge of the package blanks 10. Naturally, a larger number of wheels 11 may be employed, but practical trials have demonstrated that, by employing two wheels 11, a reliable and even infeed of the package blanks 10 can be obtained.

The elasticity of the belts 9 compensates for variations in height of the package blanks 10. At the same time, the material (for example an elastic rubber material) provides friction against the package blanks 10, which contributes to a reliable infeed or advancement of the package blanks 10.

Figure 2:
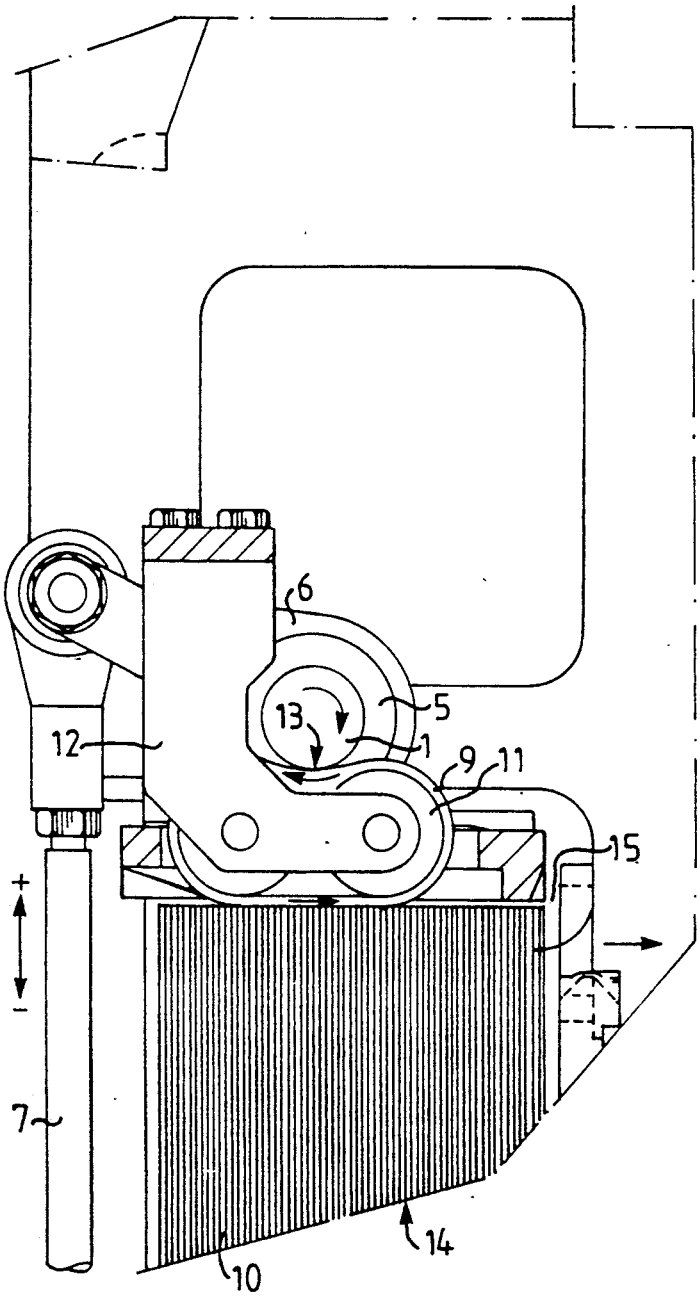

The operation of the mechanism according to the present invention is described substantially with reference to FIG. 2 in which directional arrows have been drawn.

When the pneumatic piston and cylinder assembly 8 causes the piston rod 7 to execute its positive movement (+), this movement is transferred via the lever 6 to the shaft 1. In such instance, the free-wheel hub 5 locks and the linear movement of the piston rod 7 is converted into a circular shaft movement. The shaft 1 presses on a point 13 on the endless elastic belt 9 and the circular shaft movement is then transferred to the belt 9 with its wheel 11, which thereupon feeds the package blank 10 forwardly.

The belts 9 which are oriented in the longitudinal direction of the magazine 14 are urged against the upper edge of the package blanks 10. The movement from the shaft 1 is transferred via the belts 9 and the wheels 11 to the package blanks 10 and they move forwardly in the longitudinal direction of the magazine 14. In such instance, a package blank 10 reaches the gap 15. At this point, the package blank 10 is entrapped, moved up through the gap 15 for further processing in the filling machine such as righting of the package blank, bottom sealing, filling and final sealing to form a finished package.

When the piston rod 7 executes its negative movement (−), the free-wheel hub 5 will act as a standard ball bearing in respect of the lever 6. Thus, no movement will be transferred from the negative movement of the piston rod 7 to the shaft 1. Hence, the negative movement of the piston rod 7 does not give rise to any reciprocal or return movement which affects the package blanks 10.

By making those holes in which the wheels 11 are secure in their brackets 12 slightly oval, it is possible to impart to the wheels 11 a slight springing action, which may be of advantage if the package blanks 10 are loaded into the magazine so that their upper edge is not even.

As is apparent from the above description, the present invention provides an infeed mechanism for flat-laid package blanks which functions irrespective of the quality and method of loading of the package blanks. The infeed mechanism gives an even and reliable forward movement without any disruptive return strokes.

While this invention has been illustrate and described in accordance with a preferred embodiment, it is recognized that variations and changes may be made and equivalents employed herein without departing from the invention as set forth in the claims.

What is claimed is:

1. A mechanism for individually advancing package blanks positioned in a magazine, comprising:

an endless elastic belt having an inwardly facing first surface and an oppositely positioned outwardly facing second surface, said belt passing around at least two wheels for bringing the outwardly facing second surface of the belt into contact with an edge of a package blank located in a magazine;

a shaft contacting the outwardly facing second surface of said endless elastic belt and mounted for rotation in one direction to movingly urge the endless elastic belt in a manner for advancing a package blank located in a magazine; and means for rotatably driving said shaft in said one direction to thereby movingly urge the endless elastic belt and advance the package blank.

2. The mechanism according to claim 1, wherein said means for rotatably driving said shaft includes a reciprocatingly movable pneumatic piston rod positioned in a cylinder.

3. The mechanism according to claim 2, wherein said means for rotatably driving said shaft also includes means for transferring a first movement of said piston rod within the cylinder to the shaft to cause the shaft to rotate in said one direction and for preventing a second movement of said piston rod within said cylinder from being transferred to the shaft so that the second movement of the piston rod does not result in rotation of the shaft, said first and second movements being in opposite directions.

4. The mechanism according to claim 1, wherein said shaft contacts the outwardly facing second surface of said endless elastic belt at a point intermediate said two wheels.

5. The mechanism according to claim 1, including a plurality of endless elastic belts disposed along the length of the shaft, each endless elastic belt extending around two wheels.

6. The mechanism according to claim 1, wherein said means for rotatably driving said shaft includes means for allowing rotation of said shaft in one direction and for preventing rotation of said shaft in an opposite direction.

7. The mechanism according to claim 6, wherein said means for allowing rotation of said shaft in one direction and for preventing rotation of said shaft in an opposite direction includes a free-wheel hub connected to the shaft.

8. A mechanism for individually advancing flat-laid package blanks positioned in a magazine, comprising an endless elastic belt having and outer surface for contacting an edge of package blanks located in the magazine and advancing the package blanks upon movement of the endless elastic belt;

two rotatable wheels around which said endless elastic belt passes;

a shaft positioned in contacting relationship with respect to said outer surface of said elastic endless belt to move said elastic endless belt;

a lever connected to said shaft;

a piston rod positioned within a cylinder for movement within the cylinder in first and second opposite directions, said piston rod being connected to said lever for reciprocatingly pivoting said lever in opposite directions during movement of the piston rod within the cylinder; and shaft rotating control means for causing said shaft to rotate in one direction when said piston rod is driven in the first direction and for preventing said shaft from rotating in an opposite direction when said piston rod is driven in the second direction so that rotation of the shaft results in movement of the endless elastic belt and individual advancement of the package blanks in the magazine.

9. The mechanism according to claim 8, wherein said shaft rotating control means includes a free-wheel hub connected to the shaft and surrounded by the lever.

10. The mechanism according to claim 9, wherein said cylinder is a pneumatic cylinder.

11. The mechanism according to claim 9, including a plurality of endless belts arranged along the length of the shaft, each endless belt passing around at least two rotatable wheels.

12. The mechanism according to claim 11 wherein said shaft contacts each of said endless elastic belts at a point intermediate the two wheels around which the respective endless belt passes.

13. The mechanism according to claim 8, wherein said endless belt forms a closed loop, said shaft being located outside said closed loop and contacting an outwardly facing surface of said belt at a point intermediate said two wheels.

* * * * *